United States Patent [19]

Klein et al.

[11] 4,272,260

[45] Jun. 9, 1981

[54] TORNADO-TYPE SEPARATOR

[75] Inventors: Heinrich Klein; Rudolf Pieper, both of Erlangen; Eduard Weber, Nuremberg, all of Fed. Rep. of Germany

[73] Assignee: Kraftwerk Union Aktiengesellschaft, Mulheim an der Ruhr, Fed. Rep. of Germany

[21] Appl. No.: 36,601

[22] Filed: May 7, 1979

[30] Foreign Application Priority Data

May 9, 1978 [DE] Fed. Rep. of Germany ..... 2820233

[51] Int. Cl.[3] ..... B04C 3/06; B04C 5/18

[52] U.S. Cl. ..... 55/265; 55/266; 55/340; 55/396; 55/426; 55/431; 55/466

[58] Field of Search ..... 55/261, 265, 266, 339, 55/340, 347, 391, 396, 424, 426, 431, 457, 466

[56] References Cited

U.S. PATENT DOCUMENTS

| | | | |
|---|---|---|---|
| 1,353,431 | 9/1920 | Sims | 55/431 |
| 2,323,707 | 7/1943 | Danz | 55/347 |
| 2,708,489 | 5/1955 | Stokoe | 55/431 |
| 3,235,090 | 2/1966 | Bose et al. | 209/144 |
| 3,370,407 | 2/1968 | Morawski | 55/391 |
| 3,616,619 | 11/1971 | Klein | 55/457 |
| 3,769,781 | 11/1973 | Klein et al. | 55/261 |
| 3,917,568 | 11/1975 | Klein et al. | 55/261 |

FOREIGN PATENT DOCUMENTS

| | | | |
|---|---|---|---|
| 374382 | 6/1932 | United Kingdom | 55/426 |

*Primary Examiner*—David L. Lacey
*Attorney, Agent, or Firm*—Herbert L. Lerner

[57] ABSTRACT

In a tornado-flow vortex generator for separating particulates from gases, having a cylindrical vortex chamber, an inlet tube for raw gas coaxially disposed in the vortex chamber and terminating in a nozzle for providing an advance rotation in a flow of the raw gas therethrough, a hopper diaphragm surrounding the inlet tube and formed, in vicinity of the vortex-chamber casing, with an annular particulate-discharge slot communicating with a space within a hopper, a clean-gas outlet disposed in the vortex chamber spaced from and opposite the raw-gas inlet tube, an auxiliary-gas outlet surrounding the clean-gas outlet, and an auxiliary-gas inlet disposed at the vortex-chamber casing for blowing auxiliary gas into the vortex chamber at an inclination and tangentially to the casing thereof and connected by a blower to the auxiliary-gas outlet, the improvement includes a line having valve means and connecting the hopper space with a location of the vortex generator at which a pressure exists which is lower than the pressure in the hopper space.

9 Claims, 4 Drawing Figures

TORNADO-TYPE SEPARATOR

The invention relates to a tornado-flow vortex generator and, more particularly to a tornado-type separator for separating particulates from gases, especially for purifying or cleaning stack gases at high temperature and pressure for driving a gas turbine, the vortex generator including a cylindrical vortex chamber, a coaxial inlet tube for the raw gas terminating in a nozzle which effects an advance rotation or twist in a flow of the raw gas therethrough, a hopper diaphragm surrounding the inlet tube and having, in vicinity of the vortex chamber casing, an annular particulate-discharge slot to the hopper, a clean-gas outlet disposed opposite to the raw-gas inlet tube, an auxiliary-gas outlet surrounding the clean-gas outlet, and an auxiliary-gas inlet disposed at the vortex chamber casing for blowing auxiliary gas into the vortex chamber at an inclination and tangentially to the casing and connected to the auxiliary-gas outlet by a blower.

This general description of a conventional tornado-flow vortex generator is applicable to the construction known heretofore, for example, from German Pat. No. 1 507 847.

Such tornado-flow vortex generators or tornado-type separators have found acceptance for separating solid or liquid particulates from gases.

To increase the efficiency of coal-based power plants, so-called fluidized-bed furnaces are being considered to an increasing extent. In such furnaces, stack gases having, for example, a temperature of 800° C. and a pressure of 15 bar occur, and are to be used further in gas turbines. It is understandable that the stack gases must, beforehand, be cleaned or purified intensively. In this regard, the use of tornado-flow vortex generators or tornado-type separators has been explored (See ACME Symposium Series No. 126, Vo. 68, page 270).

It is an object of the invention to provide such a tornado-flow vortex generator or tornado-type separator wherein the separating efficiency has been increased over heretofore known generators or separators of this general type, especially with a view to stack gas cleaning or purification under extreme conditions.

With the foregoing and other objects in view, there is provided, in accordance with the invention, in a tornado-flow vortex generator assembly for separating particulates from gases, having a cylindrical vortex chamber, an inlet tube for raw gas coaxially disposed in the vortex chamber and terminating in a nozzle for providing an advance rotation in a flow of the raw gas therethrough, a hopper diaphragm surrounding the inlet tube and formed, in vicinity of the vortex-chamber casing with an annular particulate-discharge slot communicating with a space within a hopper, a clean-gas outlet disposed in the vortex chamber spaced from and opposite the raw-gas inlet tube, an auxiliary-gas outlet surrounding the clean-gas outlet, and an auxiliary-gas inlet disposed at the vortex-chamber casing for blowing auxiliary gas to the vortex chamber at an inclination and tangentially to the casing thereof and connected by a blower to the auxiliary-gas outlet, in the improvement comprising a line connected to the hopper space a pressure source having a pressure lower than the pressure in the hopper space.

In this manner, a relative underpressure or negative pressure can be attained in the hopper and the quantity of dust transported through the annular particulate-discharge slot can thereby be increased.

In accordance with another feature of the invention, the tornado-flow vortex generator is constructed with a line connecting the hopper space to the raw-gas inlet tube.

In accordance with a further feature of the invention and for the purpose of providing supplemental suction, an additional suction blower can be built into the line connecting the hopper space to the raw-gas inlet tube.

In accordance with an added feature of the invention, the pressure source is the suction side of the blower for the auxiliary gas.

In accordance with an additional feature of the invention, the line for producing the underpressure extends through an auxiliary dust remover, which affords an improved separation and which is the pressure source.

In accordance with yet another feature of the invention, and in order to set the desired conditions, suitable control valves are advantageously provided in the respective lines.

In accordance with yet further features of the invention and in order to prevent dust particles from being sucked back out of the hopper, the line is advantageously provided with an enlarged cross-sectional area at an inlet location thereof to the hopper space and, for best results, terminates in a part of the hopper which is located laterally of the annular particulate-discharge slot.

In accordance with concomitant features of the invention, protective partitioning means, such as a protective screen is provided for separating the lateral hopper part from the remaining hopper space.

Other features which are considered as characteristic for the invention are set forth in the appended claims.

Although the invention is illustrated and described herein as embodied in a tornado-type separator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
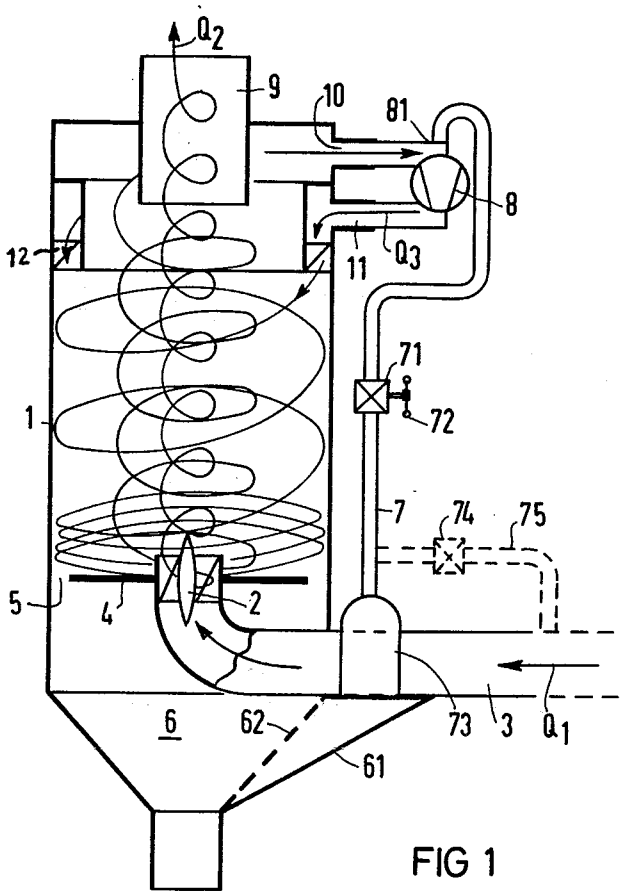
FIG. 1 is a diagrammatic sectional view of a tornado-flow vortex producing device or tornado-type separator according to the invention.

Referring now to the drawing and first, particularly, to FIG. 1 thereof, there is shown a tornado-flow vortex generator or tornado-type separator formed, in essence, of a cylindrical vortex chamber 1, into which raw gas Q1 is introduced through a coaxial inlet pipe 3. Clean gas Q2 i.e. gas which has been freed as much as possible from dust particles, leaves the vortex generator axially, at the top thereof, through a clean-gas outlet 9. Separation takes place between the raw-gas inlet 3 and the clean-gas outlet 9 and is induced by auxiliary gas Q3, which is blown in through an auxiliary-gas inlet 11 and a stationary blade or vane ring 12 near the wall of the vortex chamber 1. The auxiliary gas Q3 flows downwardly, tangentially rotating, spirally near the wall, and finally encompassing the entire outer wall, to a hopper diaphragm or shield 4. There, the auxiliary gas is deflected sharply and is conducted radially inwardly to the raw-gas inlet 3 whereat the auxiliary gas again changes the direction of flow thereof and then proceeds to flow upwardly from the bottom together with the flow of the raw gas, while rotating in the same direction, in the center of the vortex generator until it reaches the clean-gas outlet 9, at which it leaves the dust separator together with the raw gas. In principle, it is possible that the auxiliary gas alone imparts the necessary rotation to the raw gas. From an energy point of view, however, it is more desirable for the raw gas to be given a twist or rotation beforehand at the raw-gas inlet by stationary guide vanes 2 in the inlet pipe 3.

The dust particles contained in the raw gas are transported by centrifugal force and the generally axial tornado flow in direction of the wall of the vortex chamber 1 on a more or less sharply curved path. Finally, the dust particles in the vicinity of the wall come into range of the auxiliary gas and are conducted axially downwardly therewith. At the hopper diaphragm or shield 4, the auxiliary gas is deflected sharply by an angle of 90°, whereas the dust particles, due to the greater inertial mass thereof, fall through an annular particulate-discharge slot 5 into the hopper space 6 therebelow and are deposited therein. Due to the narrowness of the slot 5, only a small percentage of the auxiliary gas finds its way into the hopper space 6 and the dust particles deposit at the bottom of the large hopper space 6 due to the settling effect.

Maximum separating efficiency is obtained if the auxiliary gas Q3 is removed from the clean gas Q2 in a special manner. It has been found that the dust remaining in the clean gas is chiefly located in vicinity of the wall and has therefore already been hurled out of the central region of the outlet pipe. If the auxiliary gas is taken specifically from this region near the wall of the outlet, the major part of the quantity of dust contained in the clean gas Q2 is peeled or stripped off and can therefore be returned through the vane ring 12 to the dust separator as auxiliary gas Q3 by means of the blower 8.

To increase the separation efficiency even further, a relative underpressure or negative pressure is additionally produced artificially in the hopper space 6 and, in fact, in a manner that the hopper space 6 is connected to the suction side 81 of the blower 8 through a line 7. To control the pressure conditions, there is advantageously provided in this line 7 a control valve 71 which is adjustable by means of a hand wheel 72.

As is apparent from FIG. 1 of the drawing, for example, the suction advantageously occurs in a part 61 of the hopper located laterally to the hopper space 6 and, in fact, over an area which is as large as possible i.e. through a suitably enlarged part 73 of the line 7. The hopper part 61 located laterally to and near the hopper 6 per se can further be separated from the rest of the hopper 6 by protective screens 62 or the like.

Figure 4:
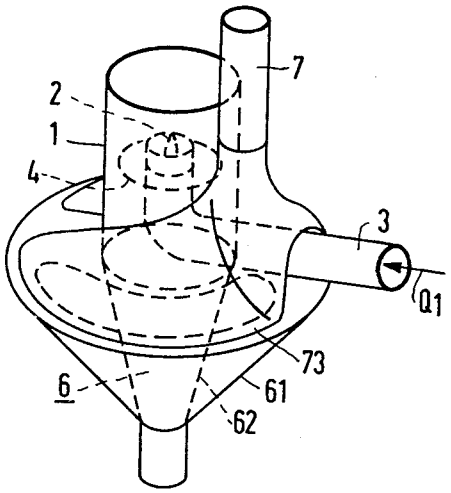
FIG. 4 is an enlarged fragmentary perspective view of FIG. 1 showing a gas exhaust from a hopper forming part of the tornado-type separator according to the invention.

FIG. 4 shows a possible construction in a perspective view from above and, indeed, there can be seen therein how the line 7 is enlarged or widened into the line part 73 and, accordingly, surrounds the inlet pipe 3.

As far as pressures are concerned, the following values might be practical for the construction shown in FIGS. 1 and 4: Assuming that the raw gas flows in at a relative pressure of 0 mm water column, about 120 mm water column underpressure or negative pressure prevails, in contrast thereto, in the clean-gas outlet 9, and consequently, at the suction side of the blower 8. On the pressure side of the blower 8 i.e. at the vane ring 12, the relative overpressure or excess pressure is about 320 mm water column. In the vortex chamber per se, a relatively high pressure arises in the vicinity of the casing or cylinder wall, and decreases toward the center. In the hopper 6, a relative overpressure or escess pressure of 40 to 60 mm water column is then preferably set by the line 7.

In this manner, the dust discharge at the annular particulate-discharge slot 5 is further increased by a considerable percentage.

In the system shown in FIG. 1, a return to the inlet or inflow pipe 3 can optionally be effected additionally or alternatively through the control valve 74 and the line 75 shown in broken lines, because an underpressure or negative pressure relative to that in the hopper space 6 also prevails therein.

Figure 2:
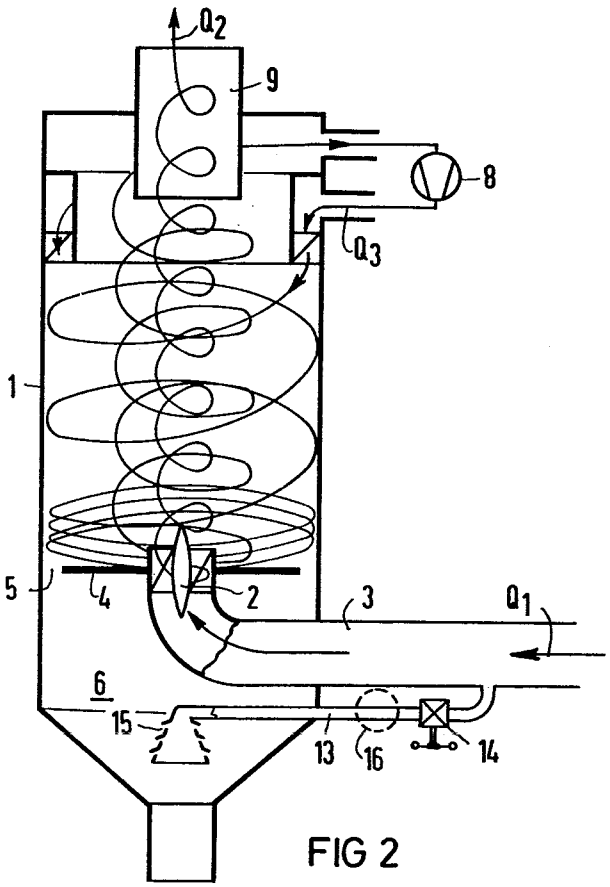
FIGS. 2 and 3 are views similar to that of FIG. 1 of other embodiments of the invention which are modified with respect to the underpressure or negative pressure production.

The system shown in FIG. 2 corresponds in essence to the system according to FIG. 1 with the sole exception that a suction hood 15, centrally located in the hopper space 6, is connected directly to the inlet pipe 3 through a line 13 and a control valve 14. The suction effect can, if desired or necessary, be supplemented by a suction blower 16. The conditions prevailing pressure-wise correspond approximately to the conditions described hereinbefore in connection with FIG. 1.

Figure 3:
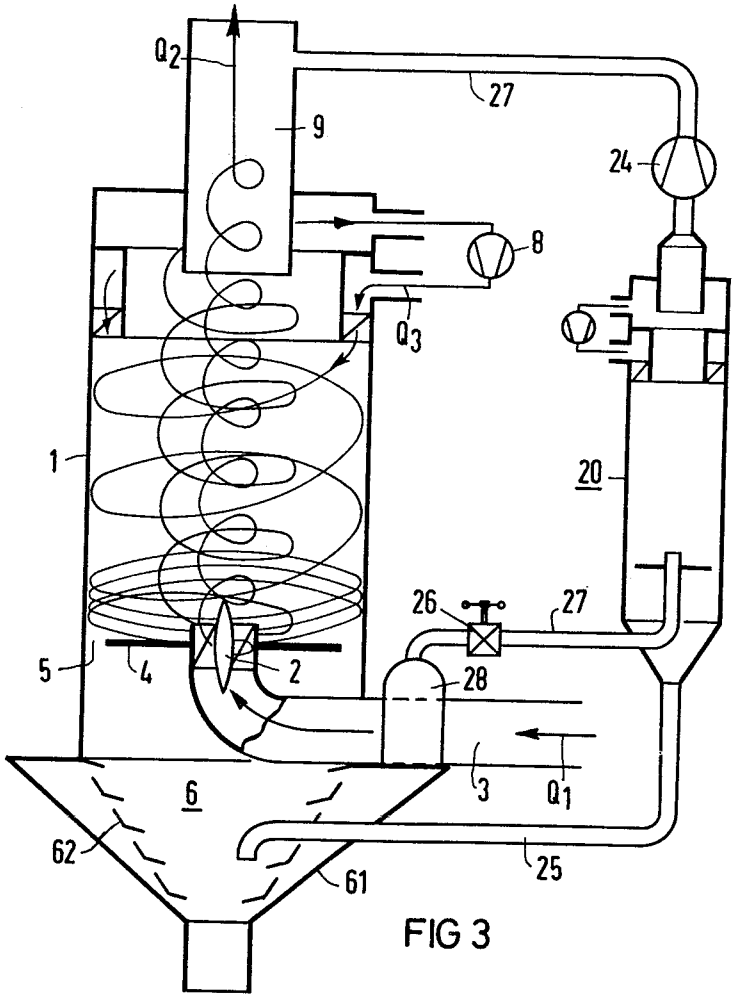

FIG. 3 shows a further embodiment of the invention wherein a suction line 27 terminating with an enlarged or widened part 28 in the lateral hopper part 61 is connected to an auxiliary dust separator 20 through a control valve 26. The construction and operation of the relatively small auxiliary dust separator 20 correspond to those of the tornado-flow vortex generator or tornado-type separator described hereinbefore in connection with FIG. 1. The gas cleaned or purified in the auxiliary dust separator 20 is then delivered to the clean-gas outlet 9 through a suction blower 24 and the remainder of the line 27. The dust particles separated in the auxiliary dust separator 20 are returned to the hopper space 6 through a line 25.

There are claimed:

1. In a tornado-flow vortex generator assembly for separating particulates from gases, having a plurality of parts including a cylindrical vortex chamber, an inlet tube for raw gas coaxially disposed in the vortex chamber and terminating in a nozzle for providing an advance rotation in a flow of the raw gas therethrough, a hopper connected to the vortex chamber, a hopper diaphragm surrounding the inlet tube and positioned in the vicinity of the vortex-chamber casing, with an annular particulate-discharge slot communicating with a space within the hopper wherein a given pressure exists, a clean-gas outlet disposed in the vortex chamber spaced from and opposite the raw gas inlet tube, an auxiliary-gas outlet surrounding the clean-gas outlet, and an auxiliary-gas inlet disposed at the vortex-chamber casing for blowing auxiliary gas into the vortex chamber at an inclination and tangentially to the casing thereof and connected by a blower to the auxiliary-gas outlet, the improvement comprising means for connecting to the hopper space a pressure source having a pressure lower than the given pressure existing in the hopper space, said means comprising a line having a control valve connected therein.

2. Tornado-flow vortex generator according to claim 1 wherein said pressure source is the raw-gas inlet tube.

3. Tornado-flow vortex generator according to claim 2 including a suction blower connected in said line connecting the hopper space to the raw-gas inlet tube.

4. Tornado-flow vortex generator according to claim 1 wherein said pressure source is the suction side of the blower.

5. Tornado-flow vortex generator according to claim 1 including an auxiliary dust separator through which said line extends, said auxiliary dust separator being said pressure source.

6. Tornado-flow vortex generator according to claim 1 wherein said line has an enlarged cross-sectional area at an inlet location thereof to the hopper space.

7. Tornado-flow vortex generator according to claim 1 wherein said hopper includes a hopper part disposed laterally of the annular particulate-discharge slot and communicating with the space within the other part of the hopper, said line terminating in said hopper part.

8. Tornado-flow vortex generator according to claim 7 including protective partitioning means for separating the lateral hopper part from the other hopper part.

9. Tornado-flow vortex generator according to claim 8 wherein said protective partitioning means comprise a protective screen.

* * * * *